US009068742B2

(12) United States Patent
Kim

(10) Patent No.: US 9,068,742 B2
(45) Date of Patent: Jun. 30, 2015

(54) BURNER FOR SCRUBBER

(71) Applicant: CSK INC. (CLEAN SYSTEMS KOREA, INCORPORATED), Yongin-si (KR)

(72) Inventor: Hyung Geuk Kim, Yongin-si (KR)

(73) Assignee: CSK INC., Gyeonggi-do (KR)

( * ) Notice: Subject to any disclaimer, the term of this patent is extended or adjusted under 35 U.S.C. 154(b) by 206 days.

(21) Appl. No.: 13/778,749

(22) Filed: Feb. 27, 2013

(65) Prior Publication Data

US 2014/0106286 A1 Apr. 17, 2014

(30) Foreign Application Priority Data

Oct. 15, 2012 (KR) ..... 10-2012-114013

(51) Int. Cl.
*F23C 3/00* (2006.01)
*F23G 7/06* (2006.01)

(52) U.S. Cl.
CPC . *F23C 3/00* (2013.01); *F23G 7/065* (2013.01); *F23G 2209/142* (2013.01)

(58) Field of Classification Search
CPC ..... F23C 3/00; F23G 2209/142
USPC ..... 431/202, 114, 187, 190, 116
See application file for complete search history.

(56) References Cited

U.S. PATENT DOCUMENTS

| | | | | | |
|---|---|---|---|---|---|
| 3,276,443 | A * | 10/1966 | Austin et al. | ..... | 126/360.2 |
| 3,869,244 | A * | 3/1975 | Von Linde et al. | ..... | 431/116 |
| 4,486,168 | A * | 12/1984 | Pratley | ..... | 431/202 |
| 5,749,719 | A * | 5/1998 | Rajewski | ..... | 431/202 |
| 5,846,068 | A * | 12/1998 | Schwartz et al. | ..... | 431/5 |
| 2010/0291492 | A1 * | 11/2010 | Poe et al. | ..... | 431/5 |

FOREIGN PATENT DOCUMENTS

| | | | | |
|---|---|---|---|---|
| JP | 11228160 | 8/1999 | | |
| WO | WO2012031666 A1 * | 3/2012 | ..... | F23G 7/08 |

OTHER PUBLICATIONS

Eaton Corporation, "Pipeline Strainers, Hayward Filtration," Oct. 2008, 16 pages.
Korean Office Action, dated Jan. 18, 2013, Korean Application No. 10-2012-0114013.

* cited by examiner

*Primary Examiner* — Avinash Savani
(74) *Attorney, Agent, or Firm* — Lando & Anastasi, LLP

(57) ABSTRACT

The present invention discloses a burner for a scrubber comprising a housing including a combustion zone to which waste gas is entered, the combustion zone having an internal central region and an opened lower portion, the housing including a mixing zone for mixing an oxidizer and fuel entered thereinto, the mixing zone being disposed along an outer side of the combustion zone and formed into a ring shape; and a metal cartridge disposed between the combustion zone and the mixing zone and provided with apertures for supplying the oxidizer and fuel mixed in the mixing zone to the combustion zone.

20 Claims, 3 Drawing Sheets

BURNER FOR SCRUBBER

CROSS-REFERENCE TO RELATED APPLICATION

This application claims priority to and the benefit of Korean Patent Application No. 2012-0114013, filed 15 Oct., 2012, the disclosure of which is incorporated herein by reference in its entirety.

BACKGROUND

1. Field of the Invention

The present invention is directed to a burner for a scrubber employed for treating exhaust gas generated in a process for manufacturing electronics devices.

2. Description of the Related Art

In general, chemicals employed for manufacturing electronic devices/elements such as display device, solar cell, light emitting diode and the like have a toxicity, a corrosiveness and an explosiveness. In addition, acid moisture and dusts generated in the manufacturing process are plentifully contained in exhaust gas.

In particular, $NF_3$ and PFCs, which are plentifully employed in a semiconductor etching process and a chemical deposition process, are gas contributing to global warming and highly poisonous gas.

$NF_3$ gas and PFCs gas are treated by a scrubber operated in a thermal plasma manner, a combustion oxidation manner or a chemical adsorption manner.

The combustion oxidation manner is most widely utilized for treating $NF_3$ gas. In the conventional combustion oxidation manner, exhaust gas is heated and decomposed by high-temperatured pure oxygen-flame formed by pure oxygen and liquefied natural gas (LNG). According to a characteristic of combustion of pure oxygen, nitrogen contained in exhaust gas is decomposed by a high-temperatured flame to additionally generate a plenty of nitrogen oxide ($NO_x$).

In recent, the exhaust standard for nitrogen oxide contained in exhaust has been reinforced so that a need for reducing nitrogen oxide is rapidly magnified. In addition to the above, the conventional pure oxygen combustion oxidation manner is disadvantageous in that a durability of a burner and parts is lowered by a high temperatured-heat so that frequent maintenance is required and an excessive operation cost is required due to an use of oxygen which is relatively more expensive than air.

SUMMARY OF THE INVENTION

An object of the present invention is to provide a burner for a scrubber which can reduce a generation of nitrogen oxide and carbon monoxide and can reduce maintenance cost and operation cost.

In order to achieve the above object, the burner for the scrubber of the present invention comprises a housing including a combustion zone to which waste gas is entered, the combustion zone having an internal central region and an opened lower portion, the housing including a mixing zone for mixing an oxidizer and fuel entered thereinto, the mixing zone being disposed along an outer side of the combustion zone and formed into a ring shape; and a metal cartridge disposed between the combustion zone and the mixing zone and provided with apertures for supplying the oxidizer and fuel mixed in the mixing zone to the combustion zone.

In addition, the housing may further comprise a ring-shaped oxidizer-preheating zone formed at an outside of the mixing zone for receiving the oxidizer entered thereto from an outside; an oxidizer-intake passage extended from the oxidizer-preheating zone to an outside of the housing; and an oxidizer-intake tube coupled to the oxidizer-preheating zone.

Furthermore, the housing may further comprise a waste gas-intake passage extended from the combustion zone to an outside of the housing; a fuel-intake passage extended from the mixing zone to an outside of the housing; an oxidizer-supplying passage extended from the mixing zone to the oxidizer-preheating zone; an oxidizer-supplying tube coupled to the oxidizer-supplying passage; a waste gas-intake tube coupled to the waste gas-intake passage; a fuel-intake tube coupled to the fuel-intake passage; and an oxidizer-supplying tube coupled to the oxidizer-supplying passage Also, the fuel-intake tube is formed such that fuel is entered from an upper surface of the mixing zone in the downward direction, and the oxidizer-supplying tube is formed such that a central axis of the oxidizer-supplying tube is perpendicular to a central axis of the fuel-intake tube at an upper side of the mixing zone and may be parallel with a tangential line of the mixing zone.

In addition, the mixing zone has a height larger than that of the combustion zone and connecting regions formed at a mid portion and a lower portion to allow the mixing zone to be connected to the combustion zone through the connecting regions, and the oxidizer supplied from the oxidizer-supplying tube may be collided with fuel at an upper portion of the mixing zone.

The oxidizer supplying tube may be formed such that the ratio ($V_A$:$V_L$) between a flow rate ($V_A$) of the supplied oxidizer and the flow rate ($V_L$) of the fuel supplied from the fuel intake tube is 1~5:1. In addition, the ratio ($A_A$:$A_L$) between the sectional area ($A_A$) of the oxidizer supplying tube and the sectional area ($A_L$) of the fuel intake tube may be 1~15:1.

Furthermore, the metal cartridge is formed in a cylindrical column shape and may comprise a metal mesh net provided with pores and a mesh net securing frame for supporting the metal mesh net on an outer surface of the metal mesh net. Also, the metal cartridge may be coupled to spatially separate the mixing zone and the combustion zone from each other in the connecting area.

In addition, the burner for the scrubber may further comprise a cartridge securing ring coupled to a lower portion of the combustion zone to secure the metal cartridge to the housing.

BRIEF DESCRIPTION OF THE DRAWING

The above and other objects, features and advantages of the present invention will become more apparent to those of ordinary skill in the art by describing in detail exemplary embodiments thereof with reference to the attached drawings, in which.

DETAILED DESCRIPTION OF THE PREFERRED EMBODIMENTS

Hereinafter, a burner for a scrubber according to the preferred embodiment of the present invention will be described in more detail with reference to the accompanying drawings.

First of all, a burner for a scrubber according to one preferred embodiment of the present invention is illustrated.

Figure 1:
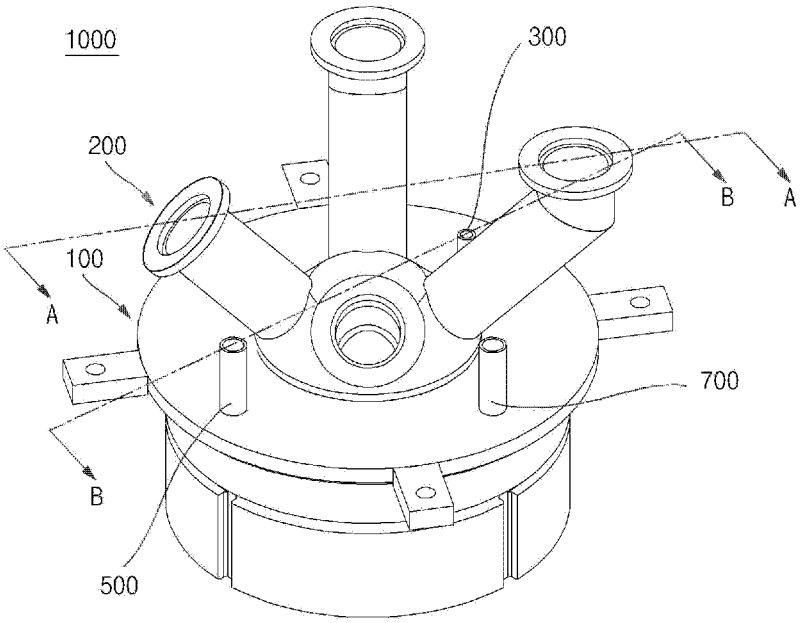
FIG. 1 is a perspective view of a burner for a scrubber according to one embodiment of the present invention.
Figure 2:
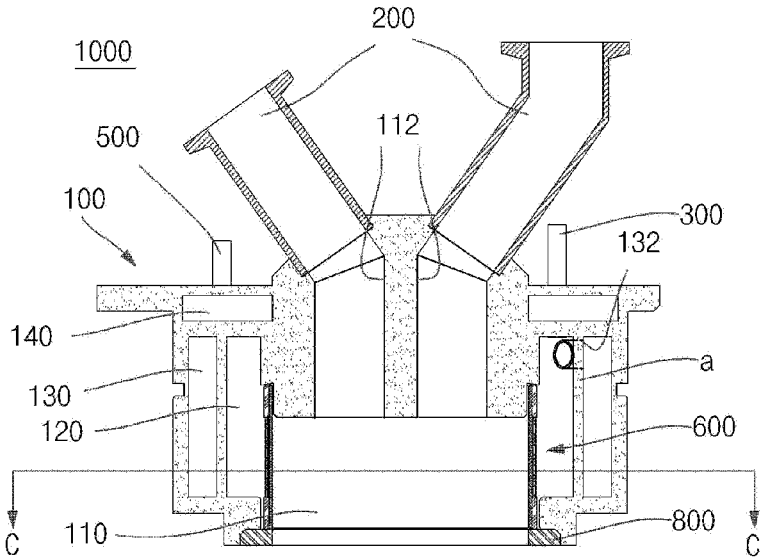
FIG. 2 is a sectional view taken along the line A-A in FIG. 1.
Figure 3:
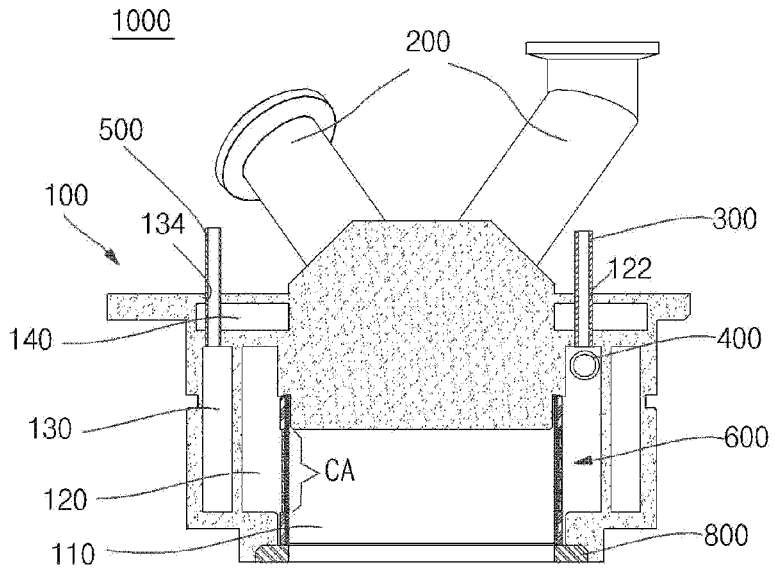
FIG. 3 is a sectional view taken along the line B-B in FIG. 1.
Figure 4:
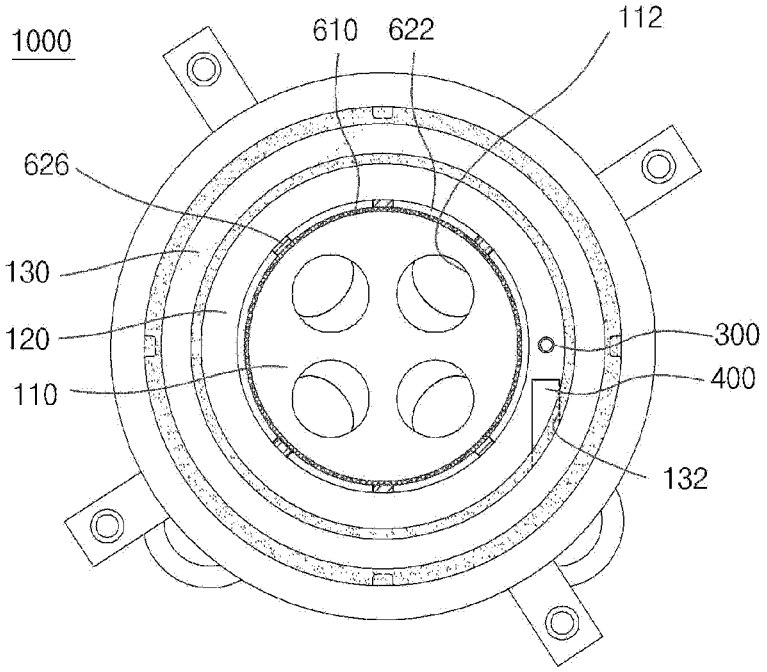
FIG. 4 is a sectional view taken along the line C-C in FIG. 1.
Figure 5:
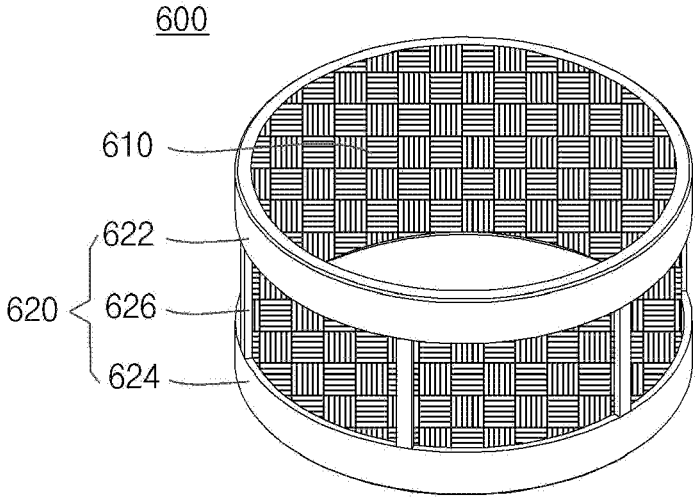
FIG. 5 is a perspective view of a metal cartridge mounted to a burner for a scrubber shown in FIG. 1.

FIG. 1 is a perspective view of a burner for a scrubber according to one embodiment of the present invention, FIG. 2 is a sectional view taken along the line A-A in FIG. 1, FIG. 3 is a sectional view taken along the line B-B in FIG. 1, FIG. 4 is a sectional view taken along the line C-C in FIG. 1, and FIG. 5 is a perspective view of a metal cartridge mounted to a burner for a scrubber shown in FIG. 1.

Referring to FIG. 1 to FIG. 5, a burner 1000 for a scrubber according to one embodiment of the present invention comprises a housing 100, a waste gas-intake tube 200, a fuel-intake tube 300, an oxidizer-supplying tube 400, an oxidizer-intake tube 500 and a metal cartridge 600. In addition the burner 1000 for the scrubber may further comprises a cooling water-intake tube 700 and a cartridge securing ring 800.

The burner 1000 for the scrubber utilizes oxygen-mixing gas involving oxygen at a certain ratio as the oxidizer. In the oxidizer, a content of oxygen is 10 volume % to 60 volume %. If a content of oxygen is excessive, heating temperature of the oxidizer becomes high so that a production of nitrogen oxide may be increased. On the contrary, if a content of oxygen is extremely low, heating temperature of the oxidizer becomes low so that the process efficiency for exhaust gas may be lowered. For example, air or compressed air is utilized as the oxidizer. Also, the burner 100 for the scrubber may employ LNG as fuel. In addition, the burner 100 for the scrubber treats waste gas through a surface combustion method at a temperature lower than 1,300° C. at which nitrogen oxide is produced, thereby reducing a production of nitrogen oxide.

The housing 100 comprises a combustion zone 110, a mixing zone 120, an oxidizer-preheating zone 130 and a cooling water zone 140. In addition, the housing 100 comprises a waste gas-intake passage 112, a fuel-intake passage 122, an oxidizer-supplying passage 132, an oxidizer-intake passage 134 and a cooling water-intake passage 142.

The housing 100 acts as a body of the burner 1000 for the scrubber and has an approximately cylindrical column shape. In addition to the cylindrical column shape, the housing 100 may have a square column shape or a hexagon column and the like. A hollow space having an opened lower end is formed in the housing 100 to provide the combustion zone 110 and the mixing zone 120. In addition, a waste gas intake tube 200, a fuel-intake tube 300, an oxidizer-supplying tube 400, an oxidizer intake tube and a cooling water-intake tube 700 are coupled to certain locations of the housing 100.

The combustion zone 110 is a hollow space formed at a central region in the housing 100 and having an opened lower end. The combustion zone 110 may have a cylindrical or square column shape according to the shape of the housing 100, and has certain diameter and height according to amount of waste gas to be treated.

The waste gas-intake passage 112 is extended from the combustion zone 110 to an outside of the housing 100. Preferably, the waste gas-intake passage 112 is extended from an upper surface of the combustion zone 110 to an upper portion of the housing 100. According to a configuration of the housing 100, the waste gas-intake passage 112 may have a linear shape in which a bending portion is formed at a middle area, a straight linear shape or a curved shape according to a configuration of the housing 100. The waste gas-intake passage 112 may have a circular section, a square section or a hexagonal section. In addition, the waste gas-intake passage 112 may have a certain diameter or a width according to amount of waste gas to be treated. The waste gas-intake passage 112 is provided with at least one passage according to amount of waste gas to be treated, and may be provided with four (4) passages so as to allow waste gas to be introduced uniformly and entirely into the combustion zone 110.

The mixing zone 120 is formed into a ring shape having a certain width and a height along an outer side of the combustion zone 110. The mixing zone 120 has a shape corresponding to an outer shape of the combustion zone 110. If the combustion zone 110 has a cylindrical column shape, the mixing zone is formed into a circular ring shape. The mixing zone 120 is the zone in which fuel supplied from the fuel-intake passage 122 ad the oxidizer supplied through the from the oxidizer-supplying passage 132 are mixed with each other. In addition, mixing gas obtained by mixing fuel and the oxidizer in the mixing zone 120 is supplied to the combustion zone 110.

A height of the mixing zone 120 is larger than that of the combustion zone 110. Also, the mixing zone is provided with connecting regions CA formed at a mid portion and a lower portion and directly connected to the combustion zone 110. In addition, the mixing zone 120 is spatially separated from the combustion zone 110 in the connecting region CA by the metal cartridge 600. In the mixing zone 120, furthermore, the oxidizer and fuel are mixed with each other above the connecting region CA to produce a mixed fuel, and the mixed fuel is then supplied to the combustion zone 110 through the connecting region CA. Accordingly, fuel and the oxidizer are mixed with each other in the mixing zone 120 and the mixed fuel is supplied to the combustion zone 110.

The fuel-intake passage 122 passes through the housing and is extended from an upper portion of the mixing zone 120 to an outside of the housing 100. Preferably, the fuel-intake passage 122 is extended from an upper portion of the mixing zone 120 to an upper portion of the housing 100. Accordingly, a central axis of the fuel-intake passage 122 is directed toward a lower portion of the mixing zone 120.

The fuel-intake tube 300 is coupled to the fuel-intake passage 122 so as to allow fuel to be entered into the fuel-intake passage from an outside.

The oxidizer-supplying passage 132 passes between the mixing zone 120 and the oxidizer-preheating zone 130. Preferably, the oxidizer-supplying passage 132 is perpendicular to the fuel-intake passage 122 at an upper portion to the mixing zone 120, and a central axis of the oxidizer-supplying passage 132 is perpendicular to a central axis of the fuel-intake passage 122. The oxidizer-supplying tube 400 is coupled to the oxidizer-supplying passage 132, and the oxidizer which is pre-heated in the oxidizer-preheating zone 130 is supplied to the mixing zone 120.

In a case where the oxidizer-preheating zone 130 is not formed in the housing 100, in the meantime, the oxidizer-supplying passage 132 may pass through the housing 100 and extend to an outside. In this case, the oxidizer is directly supplied to the mixing zone 120 from an outside.

The oxidizer-preheating zone 130 is formed into a ring shape, which has certain width and height and is extended along an outer side of the mixing zone 120. The oxidizer-preheating zone 130 is spatially separated from the mixing zone 120 by a partition wall a of the housing 100. The oxidizer entered from the outside is pre-heated in the oxidizer-preheating zone 130 and then supplied to the mixing zone 120. In the oxidizer-preheating zone 130, the oxidizer is pre-heated by heat generated by a combustion reaction performed in the combustion zone 110 and transferred to the oxidizer-preheating zone 130. In addition, the oxidizer pre-heated in the oxidizer-preheating zone 130 is supplied to the mixing zone 120 through the oxidizer-supplying passage 132.

Furthermore, since the oxidizer-preheating zone 130 is placed at an outside of the mixing zone 120, it is possible to reduce a transmission of heat, which is generated in the combustion zone 110 and transferred to the oxidizer-preheating zone 130, to an outside of the housing 100. Thus, the oxidizer-preheating zone 130 cools an outer side of the housing 100 to reduce an increase of a temperature of an outer surface of the housing 100.

In a case where a temperature of the oxidizer supplied from an outside is high, in the meantime, the oxidizer-preheating zone 130 may not be separately formed. In this case, the oxidizer-supplying passage 132 is directly connected to an outside of the housing 100 to supply the oxidizer existed in the outside to the mixing zone 120.

The oxidizer-intake passage 134 passes through the housing 100 and is extended from the oxidizer-preheating zone 130 to an outside of the housing. The oxidizer-intake tube 500 is coupled to the oxidizer-intake passage 134 to allow the oxidizer to be entered into the oxidizer-preheating zone 130 from an outside.

If the oxidizer-preheating zone 130 is not formed in the housing 100, on the other hand, the oxidizer-intake passage 134 may not be formed.

The cooling water zone 140 is disposed at upper portions of the mixing zone 120 and the oxidizer-preheating zone 130 provided at an upper portion of the housing 100, and is formed into a ring shape having certain width and height. The cooling water zone 140 allows cooling water supplied from an outside to be circulated in the upper portion of the housing 100 to prevent heat generated in the combustion zone 110 from being transferred to an upper portion of the housing 100. A cooling water-intake passage (not shown in the drawing) passes through the housing 100 and is extended from the cooling water zone 140 to an outside of the housing. The cooling water-intake passages are formed on one side and the other sides of an upper portion of the housing 100.

The waste gas-intake tube 200 is coupled to the waste gas-intake passage 112 and allows waste gas generated in a process to be entered into the waste gas-combusting zone 110.

The fuel-intake tube 300 is coupled to the waste gas-intake passage 112 and allows fuel to be entered into the mixing zone 120. The fuel-intake tube 300 is coupled to the mixing zone 120 to allow the fuel-intake tube to be perpendicular to an upper surface of the mixing zone. Accordingly, the fuel-intake tube 300 makes the fuel be entered into the mixing zone 120 through an upper surface to the mixing zone in the downward direction.

The fuel-intake tube 300 has a sectional areal $A_L$ suitable for supplying fuel corresponding to amount of fuel to be supplied to the combustion zone.

The oxidizer-supplying tube 400 is coupled to the oxidizer-supplying passage 132 and allows the oxidizer to be supplied to the mixing zone 120. The oxidizer-supplying tube 400 is coupled to the mixing zone 120 to allow the oxidizer-supplying tube to be perpendicular to the fuel-intake tube 300 at an upper portion of the mixing zone 120. In other words, the oxidizer-supplying tube 400 is formed such that a central axis of the oxidizer-supplying tube perpendicularly intersects with a central axis of the fuel-intake tube 300. In addition, the oxidizer-supplying tube 400 is adjacent to an end portion of the fuel-intake tube 300. That is, the oxidizer-supplying tube 400 is protruded from an outer surface of the mixing zone 120 to the adjacent place of the fuel-intake tube 300. In addition, the oxidizer-supplying tube 400 is formed such that a central axis of the oxidizer-supplying tube is parallel with a tangential line of the mixing zone 120. Thus, the oxidizer-supplying tube 400 allows the oxidizer, which is being supplied, to be directly collided with fuel entered from the fuel-intake tube 300 to mix the oxidizer with fuel. In addition, the oxidizer-supplying tube 400 causes mixture of fuel and the oxidizer to flow in the tangential direction of the mixing zone 120 and to produce a mixture flow in the form of vortex from an upper portion to a lower portion of the mixing zone 120.

The oxidizer-supplying tube 400 has a sectional area $A_A$ suitable for supplying an optimal oxidizer according to a flow velocity and a flow rate of the oxidizer which is being supplied and a flow velocity and a flow rate of fuel. The oxidizer-supplying tube 400 is formed such that a flow rate of fluid flowed in the oxidizer-supplying tube 400 is larger than that flowed in the fuel-intake tube 300. The oxidizer-supplying tube 400 is formed such that a ratio ($V_A$:$V_L$) between a flow rate $V_A$ of the oxidizer which is being supplied and a flow rate $V_L$ of fuel supplied from the fuel-intake tube 300 becomes 1~5:1. If a flow rate of the oxidizer supplied from the oxidizer-supplying tube 400 is small, there is a problem that the oxidizer is unevenly mixed with fuel. If a flow rate of the oxidizer supplied from the oxidizer-supplying tube 400 is small, a pressure of the mixture of oxidizer and fuel, which is sprayed into the combustion zone, is not sufficient, so enough flame is not formed. If a flow rate of the oxidizer is large, there is a problem that a large flow rate of the oxidizer obstructs a smooth supply of fuel so that uniform flame cannot be obtained.

Preferably, a sectional area $A_A$ of the oxidizer-supplying tube 400 is the same as or larger than a sectional area $A_L$ of the fuel-intake tube 300. In other words, a ratio ($A_A$:$A_L$) between the sectional area $A_A$ of the oxidizer-supplying tube 400 and the sectional area $A_L$ of the fuel-intake tube 300 may be 1~15:1. If the flow rate of the oxidizer satisfies the above mentioned-condition, it is preferable that the sectional area of the oxidizer-supplying tube 400 is the same as that of the fuel-intake tube 300. Accordingly, the oxidizer supplied from the oxidizer-supplying tube 400 is entirely collided with fuel entered from the fuel-intake tube 300 and the oxidizer and fuel can be uniformly mixed with each other.

If the sectional area $A_A$ of the oxidizer-supplying tube 400 is excessively large, there is a problem that a discharge velocity of the oxidizer is reduced so that the oxidizer is not mixed uniformly with fuel. In addition, if the sectional area $A_A$ of the oxidizer-supplying tube 400 is too small, there is a problem that a discharge velocity of the oxidizer is increased so that a smooth supply of fuel is inhibited.

The metal cartridge 600 comprises a metal mesh net 610 and a mesh net-securing frame 620. The metal cartridge 600 is inserted into the housing 100 from a lower portion of the housing and spatially separates the combustion zone 110 from the mixing zone 120. In particular, the metal cartridge 600 spatially separates the combustion zone 110 from the connecting region CA of the mixing zone 120.

After the oxidizer and fuel are mixed with each other in the mixing zone 120, mixture of the oxidizer and fuel passes through apertures formed on the metal mesh net 610 of the metal cartridge 600 and then is supplied to the combustion zone 110.

As the metal cartridge 600 is utilizes for long periods of time, the apertures of the metal mesh net 610 are clogged or damaged by a partial oxidation caused at a high temperature. Accordingly, the metal cartridge 600 should be periodically replaced. Since the entire conventional oxygen burner for the scrubber should be replaced at the time of maintaining and repairing the burner so that a time and cost required for maintaining and repairing the burner are increased. However, while the burner 1000 for the scrubber according to the present invention is operated, there is need to replace only the metal cartridge 600, so a time and cost required for maintaining and repairing the burner are reduced.

The metal mesh net 610 is formed by weaving metallic fiber and has the apertures formed thereon. The metal mesh net 610 may be formed by weaving metallic fiber into one layer or multiple layers. Preferably, in order to supply freely the oxidizer and fuel, the metal mesh net 610 has a permeability of 200 to 300 cc/min/cm$^2$. obtained by the apertures formed thereon. The metal mesh net 610 is formed from metal alloy having a heat resistance and an acid resistance, and, for example, the metal mesh net may be formed from metal such as iron-chrome alloy. The metal mesh net 610 is formed into a ring shape having a certain height so as to separate the combustion zone 110 and the mixing zone 120 from each other.

The mesh net-securing frame 620 comprises an upper ring 622, a lower ring 624 and a connecting bar 626. The mesh net-securing frame 620 is coupled to an outer side of the metal mesh net 610 to allow a cylindrical shape of the metal mesh net 610 to be entirely maintained.

The upper ring 622 is coupled to an upper portion of the metal mesh net 610 to allow a ring shape of the upper portion of the metal mesh net 610 to be entirely maintained.

The lower ring 624 is coupled to a lower portion of the metal mesh net 610 to allow a ring shape of the lower portion of the metal mesh net 610 to be entirely maintained.

The connecting bar 626 is disposed between and connected to the upper ring 622 and the lower ring 624 to allow a cylindrical shape of the metal mesh net 610 to be maintained. A plurality of connecting bars 626 are provided and arranged at appropriate intervals according to sizes of the upper ring 622 and the lower ring 624.

The cooling water intake tube 700 is coupled to the cooling water-intake passage. Accordingly, cooling water supplied from an outside is introduced into and flowed in the cooling water zone 140 through the cooling water intake tube 700 provided at one side and discharged to an outside through the cooling water intake tube 700 provided at the other side.

The cartridge securing ring 800 is formed into a ring shape and coupled to a lower portion of the combustion zone 110 of the housing 100. Accordingly, the cartridge securing ring 800 supports a lower portion of the metal cartridge 600 coupled to the combustion zone 110 to allow the metal cartridge 600 to be secured to the combustion zone. A spiral is formed on an outer surface of the cartridge securing ring 800 and a spiral is formed on a lower portion of the housing 100 so that the cartridge securing ring can be screw-coupled to the housing 100. In the meantime, in a case where the metal cartridge 600 is secured to the combustion zone by a securing means such as a screw, a use of the cartridge securing ring 800 may be omitted.

Next, the operation and effect of the burner for the scrubber according to one embodiment of the present invention is illustrated.

First, the scrubber to which the burner according to one embodiment of the present invention is mounted is illustrated.

Figure 6:
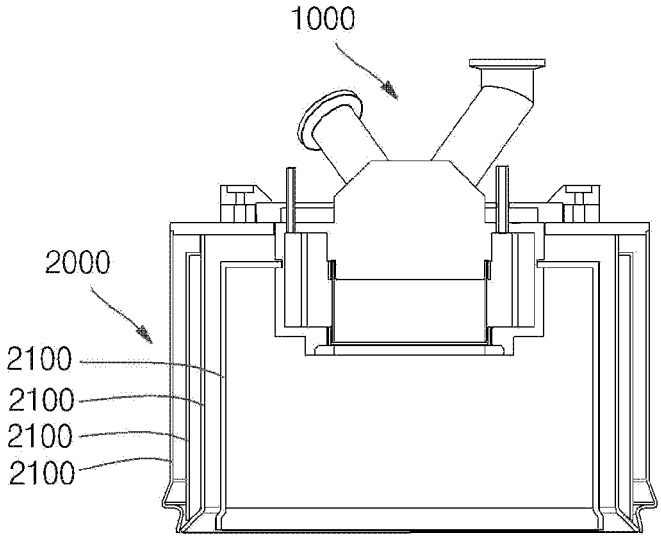
FIG. 6 is a partial sectional view of a scrubber to which a burner according to one embodiment of the present invention is mounted.

FIG. 6 is a partial sectional view of a scrubber to which a burner according to one embodiment of the present invention is mounted.

Referring FIG. 6, the scrubber comprises the burner 1000 and a combustion chamber 2000. The combustion chamber 2000 is provided with a plurality of partition walls 2100. Also, the combustion chamber may be formed into a cylindrical column shape and have a partially opened upper end. In addition, the combustion chamber 2000 may have an opened lower end, and an additional chamber (not shown) and a water reservoir (not shown) may be connected to the combustion chamber 2000. The burner 1000 for the scrubber is coupled to an upper portion of the combustion chamber 2000 to allow the combustion region 110 to be placed in an internal space of the combustion chamber 2000. In the meantime, it will be apparent that the burner 1000 for the scrubber may be coupled to the various types of combustion chambers.

Next, the operation and effect of the burner for the scrubber according to one embodiment of the present invention is illustrated.

First, the oxidizer is entered into the oxidizer-preheating zone 130 through the oxidizer-intake tube 500 of the burner 1000 for the scrubber and then supplied to the mixing zone 120 via the oxidizer-supplying tube 400. At this time, the oxidizer is sprayed from an upper portion of the mixing zone 120 to an end portion of the fuel-intake tube 300 of the mixing zone 120 with a certain pressure. In addition, since the oxidizer-supplying tube 400 is provided in a tangential direction of the mixing zone 120, the oxidizer is flowed from an upper portion of the mixing zone 120 to the lower portion in the tangential direction to form a vortex. In sequence, fuel such as liquefied natural gas (LNG) is entered into the mixing zone 120 through the fuel-intake tube 300. At this time, fuel is entered from an upper surface of the mixing zone 120 in a downward direction. Fuel is collided with the oxidizer supplied through the oxidizer-supplying tube 400 and mixed with the oxidizer to produce mixture of the oxidizer and fuel and form the vortex, and the mixture of the oxidizer and fuel is flowed in the downward direction.

The mixture of the oxidizer and fuel obtained in the mixing region 120 is sprayed into the combustion zone 110 through the apertures formed on the metal mesh net 610 of the metal cartridge 600. At this time, the mixture of the oxidizer and fuel is ignited by a separated ignition means (not shown) provided in the combustion zone 110 or the combustion chamber 2000, and the mixture of the oxidizer and fuel forms a flame in the combustion zone 110. In the burner 1000 for the scrubber, preferably, a plurality of flames in the form of a surface-flame are uniformly formed on an entire inner surface of the metal mesh net 610. In addition, the flame is formed with a short length of several centimeters on an inner surface of the metal mesh net 610. Furthermore, since the flame formed on an inner surface of the metal mesh net 610 has a short length, the flame is stable, a sway of the flame does not occur or the flame is not extinguished. Also, the mixture of the oxidizer and fuel is flowed through the apertures of the metal mesh net 610 in the mixing zone 120 and simultaneously pre-heated by heat of the metal mesh net 610, and is then sprayed into the combustion zone 110. In the burner 1000 for the scrubber, thus, a uniform temperature distribution is formed in the combustion zone 110 and the combustion zone 110 has the temperature distribution of about 1200° C. Since the flame is formed on a surface of the metal mesh net 610 and some of heat is transmitted to the metal mesh net 610, this prevents the temperature of the combustion zone 110 from being increased above the temperature of 1300° C. at which nitrogen compound is produced. In addition, the metal mesh net 610 is cooled by the mixture of the oxidizer and fuel flowed from the mixing zone 120 so that a temperature of the metal mesh net 610 is not increased excessively. On the other hands, if a flow rate of the mixture of fuel and the oxidizer supplied from the oxidizer-supplying tube 400 is insufficient, the flame formed by the mixture of fuel and the oxidizer, which is sprayed into the combustion region, is directly contacted with the metal mesh net 610 so that there is a problem that the life of the metal mesh net 10 is reduced. In addition, if a flow rate of the mixture of fuel and the oxidizer is not sufficient, the flame is propagated into the metal fiber so that a temperature of the flame is consistently lowered by a heat loss caused by a heat transmission to the fiber. Consequently, a combustion reaction cannot be consistently maintained. In the burner 1000 for the scrubber, on the other hands, since the mixture of fuel and the oxidizer in the mixing zone 120 is sprayed through the apertures of the metal mesh net 610 with a certain pressure, a backfire-phenomenon in which the flame is flowed back to the mixing zone 120 is not generated.

In the burner 1000 for the scrubber, accordingly, waste gas produced in the process for manufacturing a semiconductor device is supplied to the combustion zone 110 through the waste gas-intake tube 200 and then burned by the flame. The above waste gas contains components such $NF_3$, $SiF_4$ and TEOS, and is decomposed in the combustion zone 110. Since a temperature of the combustion zone 110 in the burner 1000 for the scrubber is maintained at a value under 1,300° C., a production of nitrogen oxide or carbon monoxide in a process for decomposing waste gas is minimized Below, the evaluation result of waste gas-treatment efficiency of the burner for the scrubber according to one embodiment of the present invention is illustrated.

Table 1 shows the waste gas-treatment efficiencies of the burner for the scrubber according to one embodiment of the present invention and a conventional oxygen burner. Table 2 shows amount of nitrogen oxide and carbon monoxide generated in the burner for the scrubber according to one embodiment of the present invention and a conventional oxygen burner.

Here, the conventional oxygen burner a utilizes only oxygen as an oxidizer and sprays fuel together with the oxidizer into a combustion zone formed therein to burn waste gas.

The evaluations for the burner 1000 for the scrubber the conventional oxygen burner were performed in a manufacturing line for a semiconductor device in a way that a concentration of each gas in waste gas entered into the scrubber through the waste gas-intake tube 200 was measured and a concentration of each gas in treated gas discharged through the scrubber was measured. The treatment efficiency of waste gas was calculated as a ratio between a concentration of each gas in waste gas entered into the scrubber and a concentration of each gas in treated gas discharged from the scrubber. In addition, contents of nitrogen oxide and carbon monoxide were measured in treated gas discharged from the scrubber.

Analyses for waste gas and treated gas were performed by utilizing Fourier Transform Infrared (FT-IR) spectrometer and QMS (Quadrupole Mass Spectrometer).

TABLE 1

| | Burner for the scrubber of the present invention | Conventional oxygen burner |
|---|---|---|
| $NF_3$ | 99.7% | 95.7% |
| $SiF_4$ | 99.9% | 99.3% |
| TEOS | 99.5% | 99.2% |

TABLE 2

| | Burner for the scrubber of the present invention | Conventional oxygen burner |
|---|---|---|
| CO | 17 ppm | 512 ppm |
| $NO_x$ | 5 ppm | 240 ppm |

As can be seen from Table 1, the treatment efficiency of the burner 1000 for the scrubber is equal to or higher than that of the ordinary oxygen burner. In the burner 1000 for the scrubber, the oxidizer and fuel are firstly mixed with each other and the mixture of the oxidizer and fuel is then supplied to the combustion zone 110, and the flame is uniformly and entirely formed on an inner surface of the metal mesh net 610. As compared with the conventional oxygen burner, accordingly, the burner 1000 for the scrubber forms relatively more uniform temperature distribution in the combustion zone, so although a temperature in the combustion zone is lower than that in the conventional oxygen burner, the treatment efficiency for the waste gas is equal to or a higher than that of the conventional oxygen gas.

As shown in Table 2, since a temperature of the combustion zone 110 of the burner 1000 for the scrubber is not exceed 1300° C., a generation of nitrogen oxide is reduced and a generation degree of nitrogen oxide is lower than that in the conventional oxygen burner. In the burner 1000 for the scrubber, furthermore, the oxidizer and fuel are mixed with each other in advance and their mixture is then sprayed into the combustion zone. Accordingly, a mixing degree of the mixture of the oxidizer and fuel is high and the flame is stably formed by a surface combustion so that a generation level of carbon monoxide is lower than that in the conventional oxygen burner.

The burner 1000 for the scrubber according to the present invention utilizes air as the oxidizer and employs a surface-combustion manner to treat waste gat at a temperature below 1,300° C. so that a generation of nitrogen oxide can be reduced.

In the burner for the scrubber, furthermore, the oxidizer and fuel are mixed with each other in advance and their mixture is then sprayed into the combustion zone. Accordingly, a mixing degree of the mixture of the oxidizer and fuel is high and the flame is stably formed by a surface combustion so that it is possible to lower a generation level of carbon monoxide.

As compared with the conventional oxygen burner, the burner for the scrubber is operated at a relatively low temperature so that a maintenance cycle can be augmented.

In addition, the burner for the scrubber according to the present invention is advantageous in that only the metal cartridge mounted in the burner is substituted for a maintenance to enable a time and cost required for the maintenance to be reduced.

Instead of pure oxygen, furthermore, the burner for the scrubber according to the present invention utilizes gas mixed with oxygen as the oxidizer so that it is possible to save an operation cost.

While the invention has been shown and described with reference to certain exemplary embodiments thereof, the technical scope of the present invention is not limited to the above embodiment, and it will be understood by those skilled in the art that various changes, modifications and additions as well as equivalent embodiments may be made therein without departing from the spirit and scope of the invention as defined by the appended claims.

What is claimed is:

1. A burner for a scrubber, comprising;

a housing including a combustion zone to which waste gas is entered, the combustion zone having an internal central region and an opened lower portion;

a mixing zone for mixing an oxidizer and fuel entered thereinto, the mixing zone being disposed along an outer side of the combustion zone and formed into a ring shape; and a ring-shaped oxidizer-preheating zone formed at an outside of the mixing zone for receiving the oxidizer entered thereto from an outside; and a metal cartridge disposed between the combustion zone and the mixing zone and provided with apertures for supplying the oxidizer and fuel mixed in the mixing zone to the combustion zone.

2. The burner for the scrubber of claim 1 wherein the housing further comprises an oxidizer-intake passage extended from the oxidizer-preheating zone to an outside of the housing.

3. The burner for the scrubber of claim 2, wherein the housing further comprises a waste gas-intake passage extended from the combustion zone to an outside of the housing.

4. The burner for the scrubber of claim 3, wherein the fuel-intake tube is formed such that fuel is entered from an upper surface of the mixing zone in the downward direction, and the oxidizer-supplying tube is formed such that a central axis of the oxidizer-supplying tube is perpendicular to a central axis of the fuel-intake tube at an upper side of the mixing zone and is parallel with a tangential line of the mixing zone.

5. The burner for the scrubber of claim 4, wherein the mixing zone has a height larger than that of the combustion zone and connecting regions formed at a mid portion and a lower portion to allow the mixing zone to be connected to the combustion zone through the connecting regions, and the oxidizer supplied from the oxidizer-supplying tube is collided with fuel at an upper portion of the mixing zone.

6. The burner for the scrubber of claim 4, wherein the ratio ($A_A$:$A_L$) between the sectional area ($A_A$) of the oxidizer supplying tube and the sectional area ($A_L$) of the fuel intake tube is 1~15:1.

7. The burner for the scrubber of claim 4, wherein the oxidizer supplying tube is formed such that the ratio ($V_A$ $N_L$) between a flow rate ($V_A$) of the supplied oxidizer and the flow rate ($V_L$) of the fuel supplied from the fuel intake tube is 1~5:1.

8. The burner for the scrubber of claim 1, wherein the metal cartridge is formed in a cylindrical column shape and comprises a metal mesh net provided with pores and a mesh net securing frame for supporting the metal mesh net on an outer surface of the metal mesh net.

9. The burner for the scrubber of claim 1, wherein the metal cartridge is coupled to spatially separate the mixing zone and the combustion zone from each other in the connecting region of the mixing zone.

10. The burner for the scrubber of claim 1, further comprising a cartridge securing ring coupled to a lower portion of the combustion zone to secure the metal cartridge to the housing.

11. The burner for the scrubber of claim 1, wherein the oxidizer contains oxygen of 10 volume % to 60 volume %.

12. The burner for the scrubber of claim 1, further comprising a fuel-intake passage extended from the mixing zone to an outside of the housing.

13. The burner for the scrubber of claim 1, further comprising an oxidizer-supplying passage extended from the mixing zone to the oxidizer-preheating zone.

14. The burner for the scrubber of claim 3, further comprising a waste gas-intake tube coupled to the waste gas-intake passage.

15. The burner for the scrubber of claim 12, further comprising a fuel-intake tube coupled to the fuel-intake passage.

16. The burner for the scrubber of claim 13, further comprising an oxidizer-supplying tube coupled to the oxidizer-supplying passage.

17. A burner for a scrubber, comprising;

a housing including:

a combustion zone to which waste gas is entered, the combustion zone having an internal central region and an opened lower portion;

a mixing zone for mixing an oxidizer and fuel entered thereinto, the mixing zone being disposed along an outer side of the combustion zone and formed into a ring shape;

a ring-shaped oxidizer-preheating zone formed at an outside of the mixing zone for receiving the oxidizer entered thereto from an outside;

a waste gas-intake passage extended from the combustion zone to an outside of the housing;

a fuel-intake passage extended from the mixing zone to an outside of the housing; and an oxidizer-supplying, passage extended from the mixing, zone to the oxidizer-preheating zone; and a metal cartridge disposed between the combustion zone and the mixing zone and provided with apertures for supplying the oxidizer and fuel mixed in the mixing zone to the combustion zone.

18. The burner for the scrubber of claim 17, wherein the housing further comprises an oxidizer-intake passage extended from the oxidizer-preheating zone to an outside of the housing.

19. The burner for the scrubber of claim 17, wherein the metal cartridge is formed in a cylindrical column shape and comprises a metal mesh net provided with pores and a mesh net securing frame for supporting the metal mesh net on an outer surface of the metal mesh net.

20. The burner for the scrubber of claim 17, wherein the metal cartridge is coupled to spatially separate the mixing zone and the combustion zone from each other in the connecting region of the mixing zone.

* * * * *

UNITED STATES PATENT AND TRADEMARK OFFICE

CERTIFICATE OF CORRECTION

PATENT NO. : 9,068,742 B2
APPLICATION NO. : 13/778749
DATED : June 30, 2015
INVENTOR(S) : Hyung Geuk Kim It is certified that error appears in the above-identified patent and that said Letters Patent is hereby corrected as shown below:

In the Claims:

Column 11, Claim 7, Line 35, replace "($V_AN_L$)" with --($V_A$:$V_L$)--.

Column 12, Claim 17, Line 20, replace "zonehaving" with --zone having--.

Column 12, Claim 17, Line 33, delete the "," after "oxidizer-supplying[[,]]".

Column 12, Claim 17, Lines 33-34, delete the "," after "mixing[[,]]".

Signed and Sealed this
Eighth Day of December, 2015

Michelle K. Lee

Michelle K. Lee
*Director of the United States Patent and Trademark Office*